United States Patent [19]

Ho

[11] 4,179,843

[45] Dec. 25, 1979

[54] CONTROLLER WITH INDIVIDUALLY OR SIMULTANEOUSLY MOVABLE ARMS

[75] Inventor: Yin F. Ho, Kowloon, Hong Kong

[73] Assignee: Madison Ltd., Hackensack, N.J.

[21] Appl. No.: 847,562

[22] Filed: Nov. 1, 1977

[51] Int. Cl.[2] ..... A63H 7/00

[52] U.S. Cl. ..... 46/126; 403/100; 403/102

[58] Field of Search ..... 46/126, 154; 403/85, 403/100, 102

[56] References Cited

U.S. PATENT DOCUMENTS 2,705,850 4/1955 Evans ..... 46/126

2,840,840 7/1958 Yamen ..... 403/100

*Primary Examiner*—F. Barry Shay

*Attorney, Agent, or Firm*—Lackenbach, Lilling & Siegel

[57] ABSTRACT

A puppet controller including a hand manipulatable frame, a pair of arms mounted on the frame for movement relative to the frame and to each other, the arms being connectible to parts of the puppet for animating the same by arm movement, and a slidable member which in one position permits movement of the arms relative to each other and to the frame and in another position constrains the arms to simultaneous movement relative to the frame.

11 Claims, 11 Drawing Figures

24
110
23
45
110
43
40
42
22
41
35
36
40
43
42
20
35
34
37
30
32
33
32
31
21
34

45
50
71
77
115
23
70
87
53
24
49
65

50
45
71
115
77
70
23
65
24
87
53
49

45
50
115
53
71
70
65
24
23
87
77
49

47
56
72
73
57
55
83
115
82
46
47

FEET
HANDS
6
7
111
65
49
53
51
40
92
90
70
47
117
77
46
115
119
116
120
118
87
48
71
100
102
42
52
45
50

111
41
66
65
74
95
93
94
92
91
98
90
75
51
70
62
63
40
47
77
76
46
78
72
116
56
73
57
55
83
87
82
48
86
60
61
42
88
52
71
85
101
105
102
103
100
107
104
84

10
11
11
10

CONTROLLER WITH INDIVIDUALLY OR SIMULTANEOUSLY MOVABLE ARMS

BACKGROUND OF THE INVENTION

While the art of puppet controllers for string puppets is well developed and productive of artistic puppet action, prior controllers required substantial skill of the operators to avoid tangles of the connecting strings, and a high degree of skill and artistry to achieve desired puppet animation. Prior string puppet controllers were relatively complex in construction, so that independent actuation of many puppet parts was beyond the coordination of relatively young children.

SUMMARY OF THE INVENTION

Accordingly, it is an important object of the present invention to provide a string puppet controller which overcomes the above-mentioned difficulties, permits of extremely easy puppet operation while controlling all desired parts of the puppet, which controller makes the control strings highly resistant to tangling, enables the controller to be preassembled at the factory with a wide variety of puppets, and is capable of economic mass production manufacture for sale at a reasonable price.

It is still another object of the present invention to provide a puppet controller having the advantageous characteristics mentioned in the preceding paragraph which is capable of selectively variable operation say to actuate certain parts independently of each other or simultaneously in synchronization with each other.

It is still another object of the present invention to provide a puppet controller of the type described which is extremely simple in structure, and sturdy and durable for a long useful life even under the abusive handling conditions of children.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENT

Figure 1:
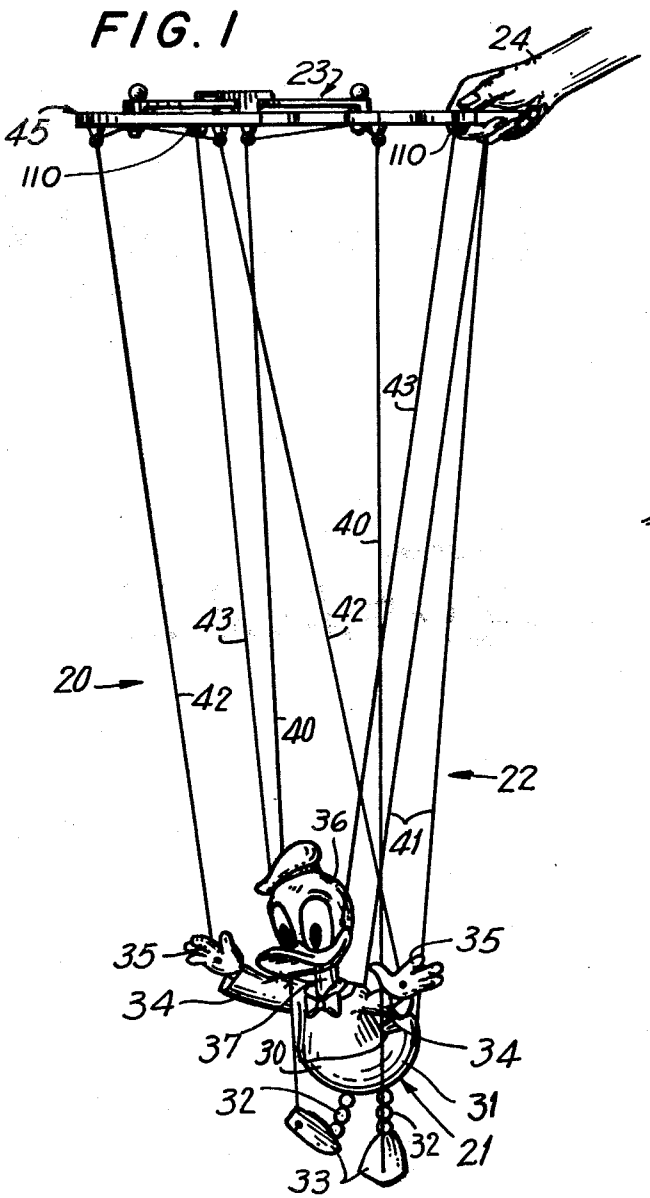
FIG. 1 is an elevational view showing an operative assembly of controller of the present invention in association with a string puppet.

Referring now more particularly to the drawings, and specifically to FIG. 1 thereof, a puppet assembly of the present invention is shown therein and generally designated 20. The puppet assembly includes a puppet 21 having freely articulated component parts and connected by a plurality of lines or strings 22 extending upwardly to a controller 23. The controller is hand held and manipulated, as by the hand 24 of an operator.

The puppet 21 is shown as the well-known embodiment of Donald Duck, but may be of any other desired representation, humanistic or animal-like. In the illustrated embodiment, the puppet 21 includes a torso 30 having a rear end 31. Articulated legs 32 depend from the lower region of torso 30 and terminate in feet 33. A pair of articulated arms 34 extend from opposite upper-side regions of torso 30, respectively terminating in hands 35.

In addition, a head 36 is connected, by an articulated neck 37 to an upper region of torso 30.

Connection means, lines or strings extend from the several puppet component parts and extremities and support the puppet for its desired motion.

Specifically, a pair of foot lines or strings 40 are connected to respective feet 33 extending upwardly therefrom, and a pair of rear lines or strings 41 are connected to opposite sides of rear end 31 and extend upwardly from the latter. Hand operating lines or strings 42 are connected to respective hands 35, extending upwardly from the hands, and a pair of head actuating lines or strings 43 are connected to opposite sides of the head 36 and extend upwardly in supporting relation with the head.

The supporting and operating strings 40–43 all extend upwardly to the controller 23, as will appear more fully hereinafter.

Referring now more particularly to FIGS. 5–8, an open, generally flat structure or frame is generally designated 45 and includes a generally flat, central or hub portion 46, from which extend a plurality of radial members or legs. In particular, a pair of radial legs 47 extend in angularly spaced relation with respect to each other from one side of hub 46; and, an additional pair of radial extensions or legs 48 extend in angularly spaced relation with each other from the opposite side of hub 46. As illustrated, each leg 47 may be approximately aligned with a respective leg 48, so that the several legs 47 and 48 may generally be angularly spaced a part 90°.

Extending between the distal ends of legs 47, remote from the central portion or hub 46, is an arcuate member 49 having its center of curvature generally coincident with the center of hub 46. An additional arcuate member 50 may extend between the distal or outer ends of legs 48, also having its center of curvature coincident with the center of hub 46, so that the arcuate members 49 and 50 may constitute diametrically opposed arcuate segments of approximately 90°. In particular, the radially inner side or edge of each arcuate segment 49 and 50, as at 51 and 52 have coincident centers of curvature, centrally through the hub 46, for a purpose appearing presently.

Outstanding from the juncture of each leg 47 with the respective end of segment 49 is an extension or ear 53.

Figure 6:
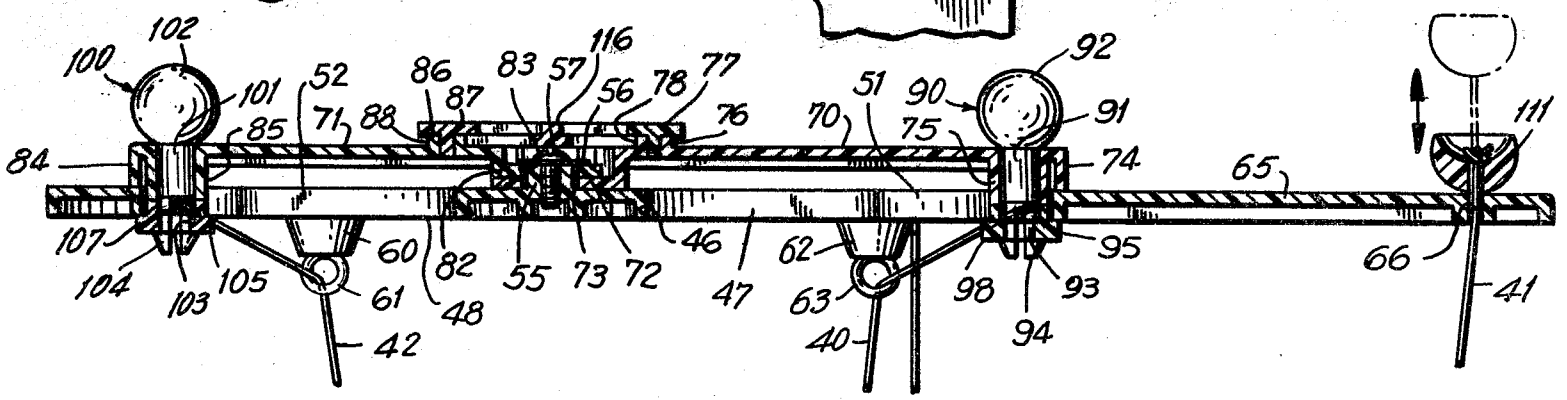
FIG. 6 is a longitudinal sectional elevational view taken generally along the line 6—6 of FIG. 5.

The central frame region or hub 46 is best seen in FIG. 6 as including an upstanding central boss or pivot 55, which may carry on its upper end an enlargement, retainer or washer 56 secured in position by a fastener or screw 57.

Depending from the underside of each radial strut or leg 48, adjacent to its juncture with the arcuate segment 50, is a downward projection or lug 60 which carries a depending line guide or eye 61. Similarly, a depending projection or lug 62 on the underside of each radial strut or leg 47 adjacent to its juncture with segment 49, carries a depending line guide or eye 63.

Extending from the radially outer or convex side of arcuate segment 49, generally coplanar therewith and approximately along a bisector of the angle between legs 47 is an extension or handle 65. Adjacent to its distal or free end, the handle 65 is provided with a through aperture or line passing hole 66. The line guides or eyes 61 and 63, and the aperture 66 will all be described more fully hereinafter.

a pair of levers or arms 70 and 71 extend from the hub 46 to respective arcuate portions or seqments 49 and 50. The arm 70 includes an inner end region 72 offset downwardly to seat on the hub 46 and having a central aperture 73 rotatably receiving the boss or stud 55. From the hub 46, the arm 70 extends across the space between legs 47, generally radially outwardly toward the arcuate segment 49, where it is provided with a depending outer end lip or flange 74 adapted to rest on the upper surface of segment 49 along the edge 51. Just inwardly of the end lip 74, there depends from the arm 70 an open-ended tubular formation or receiver 75. The tubular receiver 75 depends closely adjacent to the concavely arcuate edge 51 of frame segment 49, and opens vertically upwardly and downwardly.

The upper side of arm 70, adjacent to and spaced from the inner end region 72, may be provided with an upstanding land or boss 76, on which is fixed an enlarged head or retainer 77, defining with the boss 76 an undercut periphery, as at 78.

The radial arm 71 is similarly provided on its inner end with a depressed end portion 82 having a central through aperture 83 rotatably receiving journal boss 55. The end portion 82 of arm 71 may rest rotatably on the end portion 72 of arm 70. The enlarged retainer or washer 56 overlies the upper inner arm end region 82 to retain the end regions 82 and 72 rotatably on the stub or boss 55.

Depending from the radially outer end of arm 71 into engagement with the upper surface of arcuate segment 50, adjacent to its inner edge 52, is a lip or flange 84. A tubular, openended receiver 85 depends from the arm 71, adjacent to and spaced inwardly from the flange 84, just inward of the inner frame member edge 52.

Upstanding from the arm 71, adjacent to and spaced from its inner end region 82, is a boss or land 86; and, an enlargement or head 87 is secured on the boss 86, combining therewith to define an undercut periphery 88.

It will now be apparent that the arms 70 and 71 are both mounted for rotative or swinging movement about the single axis of pin or stud 55, to move the outer ends of the arms along respective concave edges 51 and 52.

A fastener member or pin 90 includes a generally cylindrical shank 91 inserted downwardly in receiver 75 and an enlarged knob or head 92 projecting above the arm. Depending from the lower end of shank 91 is a reduced bifurcated portion 93 having tapered enlargements 94 on its free ends. A retaining member 95, which may be of generally annular configuration, has an internal diameter configured for snap engagement over the enlargements 94 onto the reduced region 93, for retention thereon by the enlarged portions 94. The retainer 95 may have spaced slots 96, and may be provided on its lower region with an enlarged circumferential rim or ridge 97 defining an upwardly facing shoulder 98. In the assembled condition, it will be apparent from FIG. 6, that the retainer 95, and particularly its shoulder 98, combines with the flange 74 for constrained sliding engagement with the inner edge region of segment 49, such that the outer end region of arm 70 and fastener 90 with its retainer 95 combine to define a follower for the guiding edge 51 to constrain the arm 70 against other than planar movement about pivot 55.

The outer end of swingable arm 71 is similarly provided with follower means 100, including a shank 101 in receiver 85 with an enlarged head or knob 102 above the arm and a reduced bifurcated portion 103 depending from the shank and having its lower free ends provided with retaining enlargements 104. An annular retainer or loop 105 is snap engaged over the enlargements 104 onto the reduced portion 103 and includes a circumferential enlargement 107 defining an upwardly facing shoulder cooperating with the depending flange 84 to insure following engagement of the outer arm end with the arcuate guide member 50.

Figures 8, 9, 10, 11:
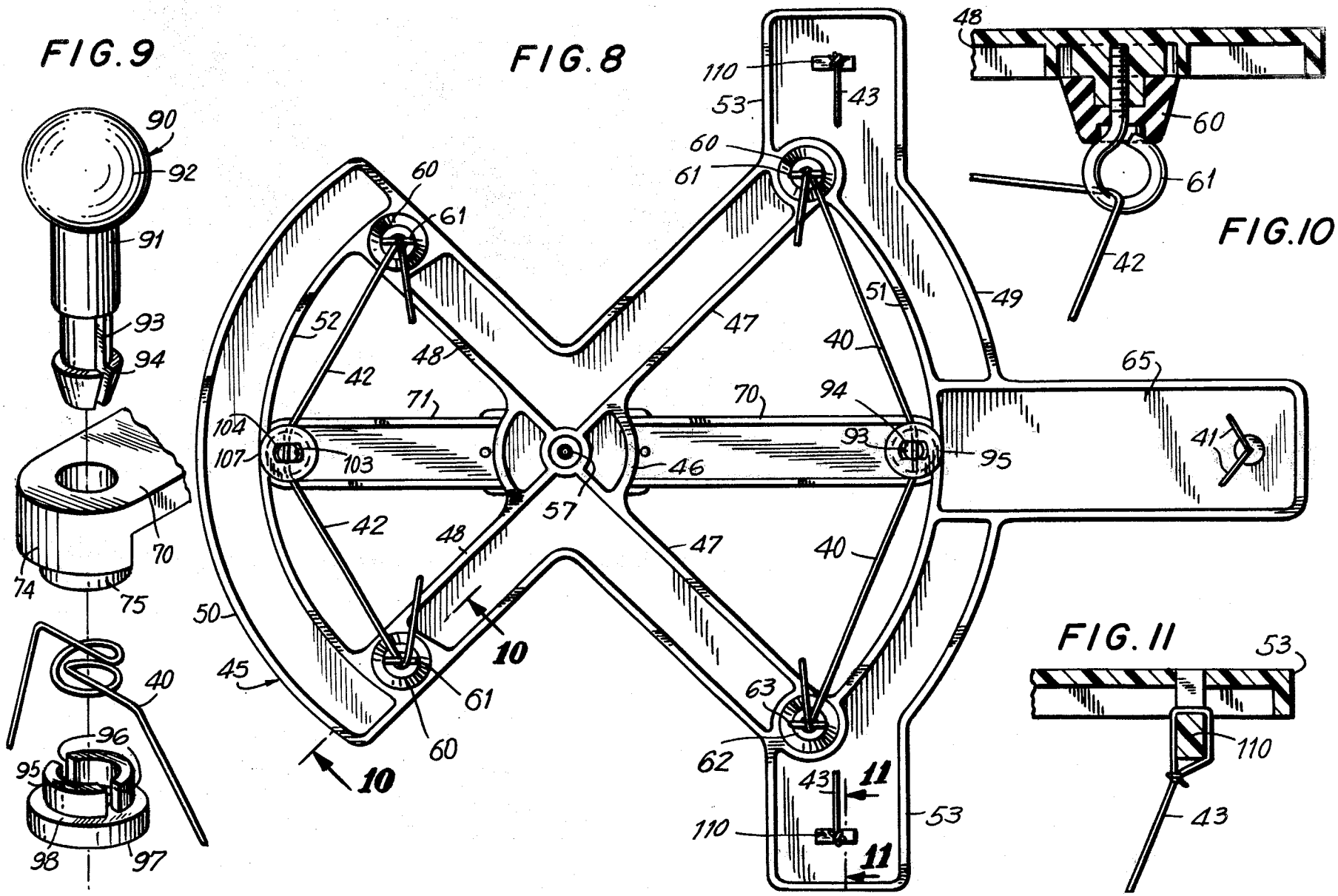
FIG. 8 is a bottom plan view of the controller of the instant invention.
FIG. 9 ia an exploded perspective view illustrating the end construction of a controller arm.
FIG. 10 is a fragmentary sectional elevational view taken generally along the line 10—10 of FIG. 8.
FIG. 11 is a fragmentary sectional view taken generally along the line 11—11 of FIG. 8.

Thus, the follower means 90 and 100 may be substantially identical, as shown in FIG. 9, each serving for securement to a line 40, as seen in FIG. 9, the line being turned about the reduced portion 93, through openings 96 for securement in position. The lines 42 may be similarly secured to the follower means 100. Additionally, the lines 40 may pass from the follower means fastener 90 generally chordally with respect to the arcuate guide segment 49 outwardly through respective guides or eyes 63 for connection to feet 33. Similarly, the strings or lines 42 may pass oppositely outwardly from the fastener-follower means 100 through respective loops or eyes 61 for securement to hands 35.

Depending from rrespective lateral extensions or ears 53 may be loops or hangers 110, see FIGS. 8 and 11. Each of the head lines or strings 43 may extend upwardly to and be tied to a respective hanger 110.

In addition, the rear lines 41 may extend upwardly and through handle opening 66, for connection on the upper side thereof to an enlargement or hand grip member 111.

Figure 5:
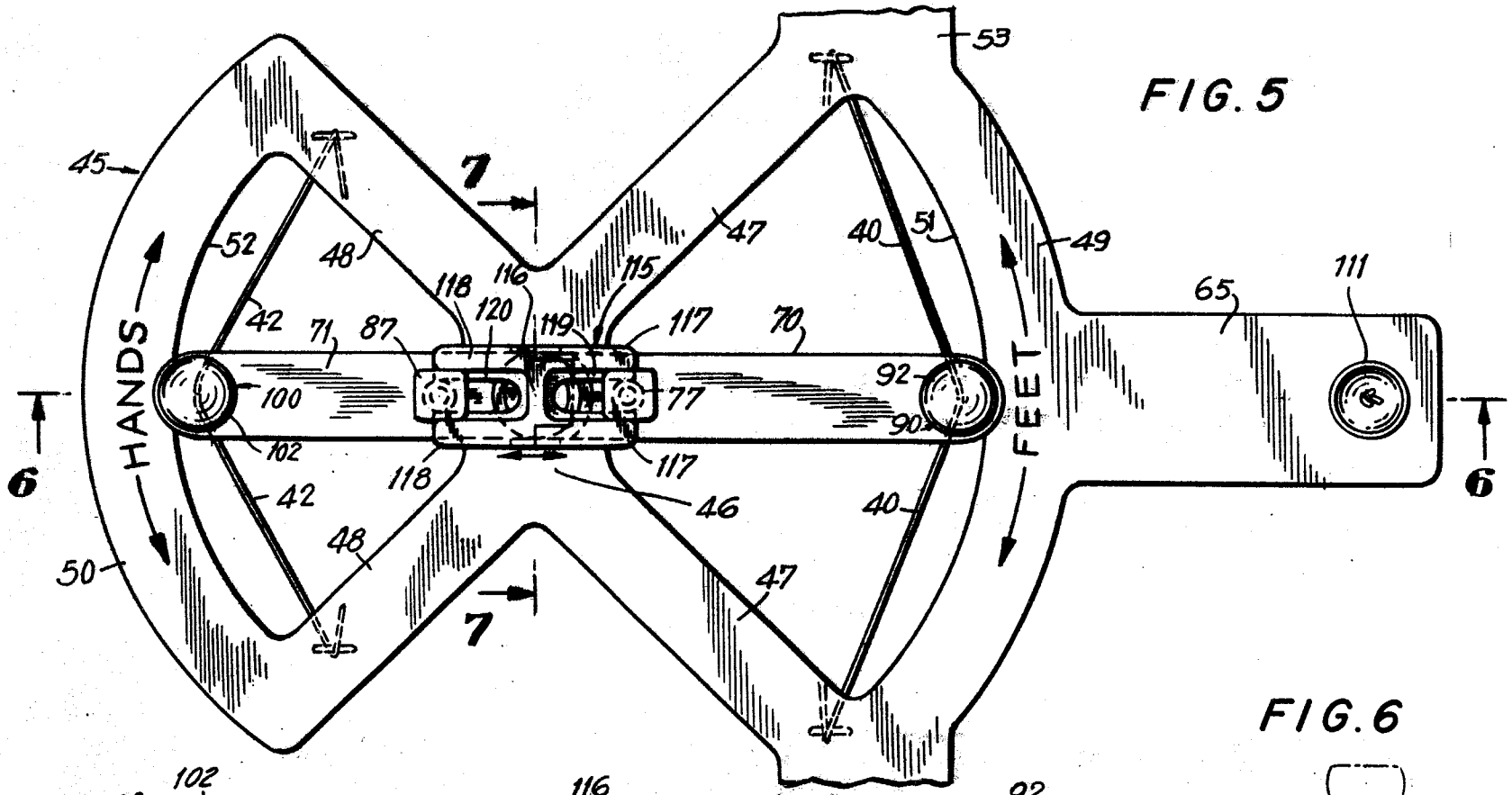
FIG. 5 is a partial, top plan view of the controller, enlarged for clarity.

A constraining connector or link member is generally designated 115, and may be generally flat and of a H-shaped configuration, including a medial lateral region 116, a pair of generally parallel legs 117 extending in one direction from opposite ends of the lateral portion, and an additional pair of generally parallel legs 118 extending in the opposite direction from opposite ends of the lateral portion. As seen in FIG. 5, the lateral connector portion 115 lies over the mutual pivotal axis of arms 70 and 71, the legs 117 extending at their distal regions onto opposite sides of head 77. Simultaneously, the legs 118 extend onto opposite sides of the head 87 of arm 71. In addition, inner ledges 119 on respective legs 117 engage in the undercut regions 78 beneath head 77, while inner ledges 120 on legs 118 engage in undercut regions 88 beneath head 87. It will be appreciated that this snug conforming reception of heads 77 and 87 between the legs 117 and 118 of connector 115 serves to positively constrain the arms 70 and 71 against relative pivotal movement. That is, the arms 70 and 71 are constrained to simultaneous rotation about the axis of stud 55.

Figure 2:
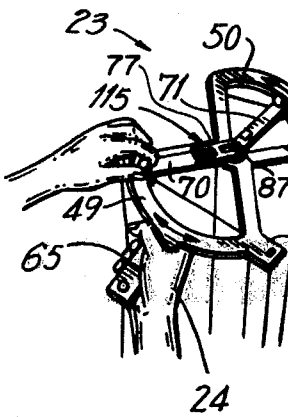
FIG. 2 is a top perspective view showing a puppet controller of the present invention in one selected condition of operation.

Now considering operation of the instant device and referring to FIG. 2 thereof, it will be seen that the connector or link 115 has been shifted relative to the arms 70 and 71 so as to disengage from the enlarged head 87 of arm 71. Therefore, the arms 70 and 71 are independently rotatable about the coincident axes of stub 55. In this condition, an operator may swing either of the arm 70 or 71, as desired. In FIG. 2 the arm 70 is being swung by the operator, which arm actuates the feet, as seen by the legend in FIG. 5.

Figure 4:
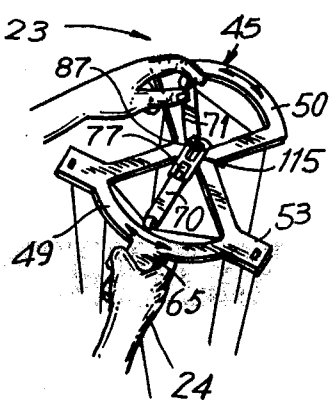
FIG. 4 is a top perspective view showing the puppet controller of the present invention in still another selected condition of operation.
Figure 7:
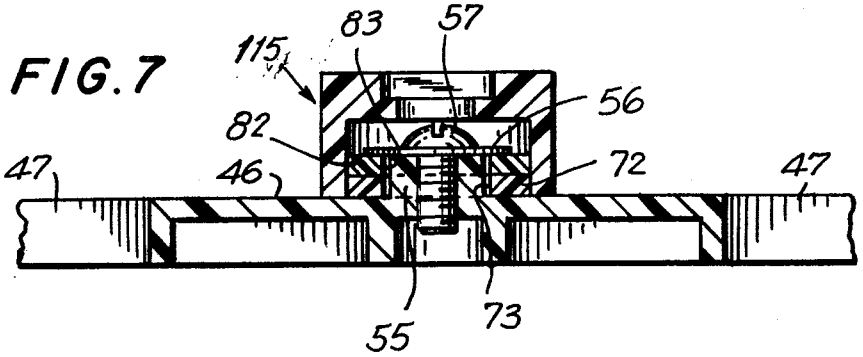
FIG. 7 is a transverse sectional view taken generally along the line 7—7 of FIG. 5.

With the connector 115 disengaged from one or the other of arms 70 nd 71, the puppet hands may be operated, as seen in FIG. 4, by swinging the arm 71, the head 102 providing a handhold for effecting this actuation.

Figure 3:
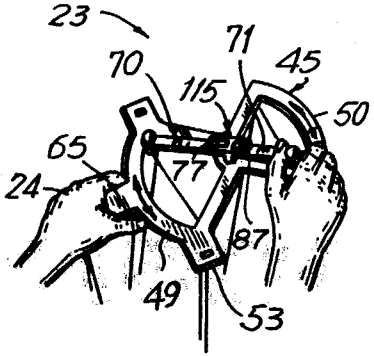
FIG. 3 is a top perspective view showing a puppet controller of the present invention in another selected condition of operation.

In FIG. 3 it will be seen that the connector 115 is shown in its rigidly connecting relation with respect to both arms 70 and 71, the condition shown in FIG. 5. In this condition swinging movement of either arm 70 and 71 by operation of either knob 92 or 102, will effect simultaneous swinging operation of both arms, to simultaneously actuate both the hands and feet.

Of course, the head may be operated by a rocking movement of the frame 45, as by the operator's hand holding handle 65. Also, the puppet's rear end strings 41 may be actuated by raising and lowering the knob 111 as seen in FIG. 6.

From the foregoing, it is seen that the present invention provides a string controlled puppet which is extremely simple in structure and operation, being almost tangle-proof even for young operators, and which otherwise fully accomplishes its intended objects.

Although the present invenion has been described in some detail by way of illustration and example for purposes of clarity of understanding, it is understood that certain changes and modifications may be made within the spirit of the invention.

What is claimed is:

1. A puppet controller for a puppet having movable hands and feet, said controller comprising a frame for manual holding and manipulation, a first arm mounted on said frame for movement relative to the latter and connectible to the puppet feet for animating the same, a second arm mounted on said frame for movement relative to the latter independently of said first arm and connectible to the puppet hands for actuation thereof, constraining means mounted on said controller frame and selectively associated with said first and second arms to constrain each said arm to movement only with the other relative to said frame for simultaneous animation of said feet and hands.

2. A puppet controller according to claim 1, said first and second arms each being swingable relative to said frame for independent and simultaneous arm swinging movement.

3. A puppet controller according to claim 2, in combination with pivot means mounting said arms for said swinging movement.

4. A puppet controller according to claim 3, said pivot means comprising a pivotal connection mounting said arms for swinging movement about a single axis.

5. A puppet controller according to claim 3, said constraining means comprising a connector selectively connectible to said pair of arms for effecting said simultaneous arm movement.

6. A puppet controller according to claim 5, said connector comprising a link having its opposite ends respectively connectible to said arms.

7. A puppet controller according to claim 6, in combination with pivot means mounting said arms for said swinging movement, and said link being rigid for selectively rigidly connecting said arms together.

8. A puppet controller for a puppet having movable hands and feet, said controller comprising a frame for manual holding and manipulation, a first arm mounted on said frame for movement relative to the latter and connectible to the puppet feet for animating the same, a second arm mounted on said frame for movement relative to the latter independently of said first arm and connectible to the puppet hands for actuation thereof, constraining means mounted on said controller frame and selectively associated with said first and second arms to constrain each said arm to movement only with the other relative to said frame for simultaneous animation of said feet and hands, said first and second arms each being swingable relative to said frame for independent and simultaneous arm swinging movement, and pivot means mounting said arms for said swinging movement, said frame comprising arcuate guide means associated with each arm, and located remotely from said pivot means and follower means on each arm for following said guide means.

9. A puppet controller according to claim 8, said guide means each having a center of curvature coincident with the pivot means of the respective arm.

10. A controller for a puppet having movable hands and feet, said controller comprising a frame for manual holding and manipulation, a first arm mounted on said frame for movement relative to the latter and connectible to the puppet feet for animating the same, a second arm mounted on said frame for movement relative to the latter independently of said first arm and connectible to the puppet hands for actuation thereof, and constraining means selectively associated with said first and second arms to constrain the same to simultaneous movement relative to said frame for simultaneous animation of said feet and hands, said first and second arms each being swingable relative to said frame for independent and simultaneous arm swinging movement; pivot means mounting said arms for said swinging movement, said frame comprising arcuate guide means associated with each arm, and follower means on each arm for following said guide means, said guide means each having a center of curvature coincident with the pivot means of the respective arm, said follower means each comprising a fastener for securing to the respective arm lines connectible to a puppet.

11. A puppet controller according to claim 10, in combination with line eyes on said frame for freely passing lines from said fasteners to a puppet. /

* * * * *